US006467665B1

(12) United States Patent
Jenkins

(10) Patent No.: US 6,467,665 B1
(45) Date of Patent: Oct. 22, 2002

(54) SPORTS EQUIPMENT TRANSPORTATION AND STORAGE BAG

(76) Inventor: Lavette R. Jenkins, 108 Gingergate Dr., Apex, NC (US) 27502

( * ) Notice: Subject to any disclaimer, the term of this patent is extended or adjusted under 35 U.S.C. 154(b) by 0 days.

(21) Appl. No.: 09/887,632

(22) Filed: Jun. 22, 2001

(51) Int. Cl.[7] ..... A45F 3/04

(52) U.S. Cl. ..... 224/628; 224/651; 224/652; 224/653

(58) Field of Search ..... 224/628, 651, 224/652, 630, 653, 654, 656

(56) References Cited

U.S. PATENT DOCUMENTS 2,552,443 A * 5/1951 Molinari ..... 224/235
5,490,619 A * 2/1996 Boyar ..... 150/103
5,509,589 A * 4/1996 Kliot ..... 224/637
5,573,166 A * 11/1996 Leja ..... 224/630
5,676,295 A * 10/1997 Gelb ..... 224/628
5,692,660 A * 12/1997 Stewart ..... 190/103
5,826,771 A * 10/1998 Peng ..... 224/645
6,092,702 A * 7/2000 Cassidy, IV ..... 224/153
6,193,034 B1 * 2/2001 Fournier ..... 190/107
6,332,566 B1 * 12/2001 Rota ..... 224/153
6,367,674 B1 * 4/2002 Tabor ..... 224/153

* cited by examiner

*Primary Examiner*—Stephen K. Cronin
(74) *Attorney, Agent, or Firm*—Coats & Bennett, P.L.L.C.

(57) ABSTRACT

A sports equipment bag such as a soccer bag for holding and transporting equipment such as shoes, shin guards, a soccer ball and the like. The equipment bag includes a back and bottom formed from sufficiently rigid material to enable the bag to stand alone upright. Two sides formed from a mesh material are connected to the back and bottom of the bag. The mesh material extends around to form the sides and front of the bag. Further, the mesh material is disposed with respect to the bag such that an open top area is formed that permits equipment such as a ball, shoes, shin guards and the like to be deposited into the bag through the top opening.

36 Claims, 2 Drawing Sheets

SPORTS EQUIPMENT TRANSPORTATION AND STORAGE BAG

BACKGROUND OF THE INVENTION

The present invention relates generally to the field of sports equipment storage and transportation, and specifically to a backpack-type bag useful in carrying and containing soccer equipment.

The game of soccer (known as "football" outside of the United States) is one of the most popular sports in the world. In recent years, soccer has enjoyed a tremendous growth in popularity in the United States as well. Part of the appeal of the game of soccer is that little equipment is required to play it. At a minimum, a soccer ball, a relatively flat open field, and some means of marking the goals will suffice. In practice, however, soccer players generally utilize additional equipment, including cleated shoes and shin guards, in addition to a uniform comprising a shirt, shorts, and athletic socks. Like many athletes, soccer players may additionally carry such accoutrements as a water bottle, a towel, bandages, sweatbands, sunglasses, and the like.

A wide variety of containers for storing and transporting this equipment is known in the art, including duffel bags, shoulder bags, backpacks, and the like. These prior art sports equipment storage and transportation containers are deficient in a number of ways. Most of them are of fabric or plastic construction, and are hence opaque. Thus, a player cannot tell at a glance what equipment is in the container, or alternatively if desired items are missing. Many prior art sports containers also lack sufficient internal structural integrity to retain their shape absent a fill load of contents. Thus, when the major articles of equipment have been removed from such containers, they collapse into an untidy heap, making it difficult to retrieve additional items or to insert equipment back into the container. Those prior art containers that do retain their shape when empty are often bulky and take up considerable storage space even when they are not storing equipment.

Thus, there exists a need in the art for a soccer equipment storage and transportation bag that readily displays its contents, is compact and lightweight, and retains its shape when empty and in use but folds into a compact size and shape when empty and stowed.

SUMMARY OF THE INVENTION

The present invention entails a sports equipment bag that comprises a back and a bottom. Two pliable and flexible panels are secured to both the back and bottom and extend from the bag to form the sides and front of the sports equipment bag. As the panels extend from the back towards the front, they at least partially overlap and form an open top that is generally defined by the back and upper edges of the two panels. Thus, equipment and objects can be deposited downwardly through the open top of the bag into a holding area defined by the bottom, back and two pliable panels. In one particular embodiment of the present invention, the two pliable panels include two mesh panels. In this case, the two mesh panels extend from opposite edges of the bag and are secured along a lower edge to the bottom. About the front of the bag the two mesh panels overlap, at least partially. In some embodiments, the upper edges of the two mesh panels which tend to extend diagonally across the front of the bag and crisscross in the process, can be provided with an elastic member of structure that permits the upper edges of the mesh panels to be stretched, thereby to enlarge the open top of the bag if required.

Other objects and advantages of the present invention will become apparent and obvious from a study of the following description and the accompanying drawings that are merely illustrative of such invention.

DETAILED DESCRIPTION OF THE INVENTION

The present invention relates to a compact, lightweight, durable sports equipment storage and transportation bag. Although the invention is described and depicted herein with reference to soccer equipment, the present invention is not so limited. In fact, the present invention finds utility in a wide variety of applications, including the storage and transportation of a wide variety of sports equipment. Additionally, the bag of the present invention is useful to hikers and campers, as well as students, artists, emergency medical personnel—in short, anyone who has occasion to store and carry equipment, material, or supplies, and for whom it would be useful to visually inventory, quickly locate, and easily insert or extract items from the container.

Figure 1:
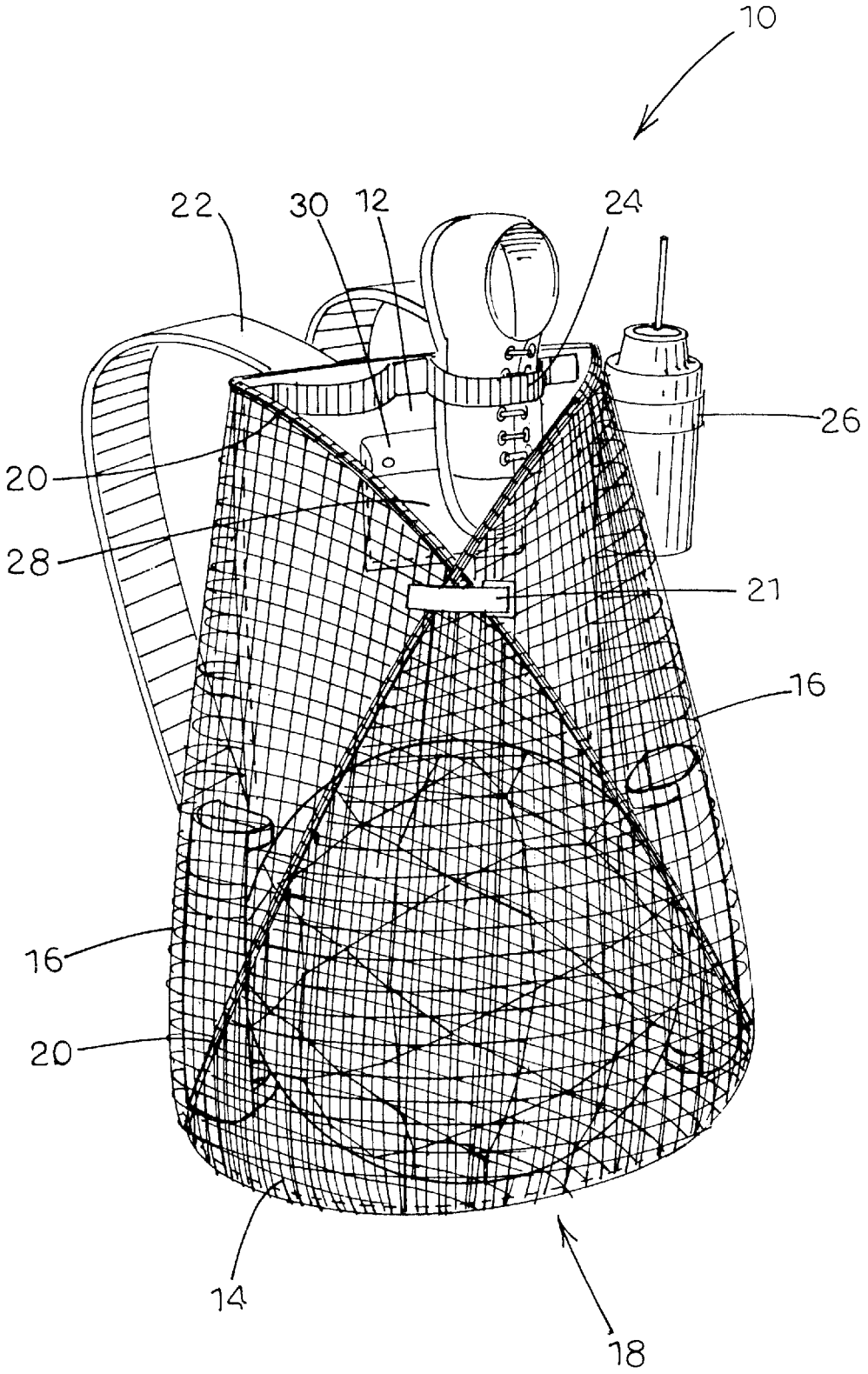
FIG. 1 is a perspective view of the sports equipment bag of the present invention.

A sports equipment bag of the present invention is depicted in perspective view in FIG. 1, and indicated generally by the numeral 10. The sports bag comprises a back member 12 and bottom member 14, both of a semi-rigid construction, as will be further explained herein. Affixed to the back 12 and bottom 14 are side panels 16, which may be formed of a mesh material. The side panels 16 may partially overlap, forming a front surface 18. A storage container is formed by the back 12, side panels 16, and front surface 18, closed on the lower end by bottom 14, and generally open on the top end. The storage container is effective to store and transport sporting equipment such as a soccer ball and shin pads, as depicted in FIG. 1, as well as a wide variety of other equipment and items. The side panels 18 may be formed of a mesh construction. This reduces the weight of the bag 10, and allows visual inspection of its contents.

Along the upper, unattached edge of mesh panels 16 may be formed an elastic edging 20. The elastic edging 20 is constructed and arranged so as to allow the equipment bag 10 to be opened for the insertion and extraction of equipment therein by stretching the elastic edging 20, thus opening the mesh panels 16 and reducing the effective area of the front surface 18.

At or near the point of overlap of mesh panels 16 at the front surface 18 is a clasp 21 operative to hold the mesh panels 16 together. Clasp 21 may be any releasable securing mechanism known in the art, such as for example, a snap, a button and corresponding buttonhole, a plastic or metal hook and corresponding eyelet, tie strings, one or more straps and a buckle, D-rings, or other mechanism for securing the straps together, a hook and loop fastener, or the like. In use, equipment stored in the bag 10 may tend to force mesh panels 16 apart, enlarging the opening formed in the top of bag 10 by stretching the elastic edging 20, and thus may become dislodged from within the bag 10. By affixing the clasp 21, the user may secure equipment within the bag 10, such as during transit to or from the playing field. Once on location, the clasp 20 may be disengaged, allowing quick and easy access to the equipment in the bag 20 via stretching the elastic edging 20.

Affixed to the back side of the back member 12 is a pair of shoulder straps 22. Shoulder straps 22 are generally vertical in orientation, and are spaced apart horizontally so as to function as conventional backpack straps, supporting the sports equipment bag 10 on a user's back. Shoulder straps 22 are preferably adjustable, and may be formed in multiple segments connected with adjustable buckles or connectors, as is well known in the arts. In one embodiment, at least the upper extent of shoulder straps 22 are padded, to increase user comfort in transporting the sports equipment bag 22. In another embodiment, the shoulder straps 22 may vary in width along their length, for example, being wider at the top and narrower at the bottom, again for user comfort. Additionally, in any of the described embodiments, the straps 22 may include a chest strap extending horizontally between the straps 22, to assist in the retention and position of the straps 22 on a user's shoulders. The chest strap is preferably releasably secured via a buckle, hook and loop fastener, or similar means, as is well known in the art. Additionally, one or more of the straps 22 may include a pouch for the retention of sunglasses, currency, a cigarette pack, or the like. Additionally, the bag 10 of the present invention may simply be provided with a single shoulder strap such as the type generally employed on duffle bags. In fact, the bag 10 could be designed to accommodate either dual straps or a single shoulder strap.

Figure 2A:
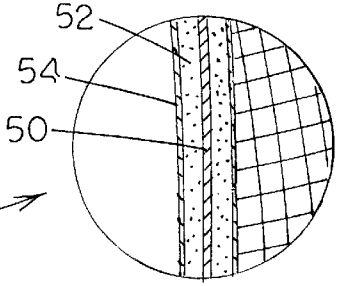
FIG. 2A is an enlarged detail of a portion of FIG. 2, showing the construction of the back member.
Figure 2:
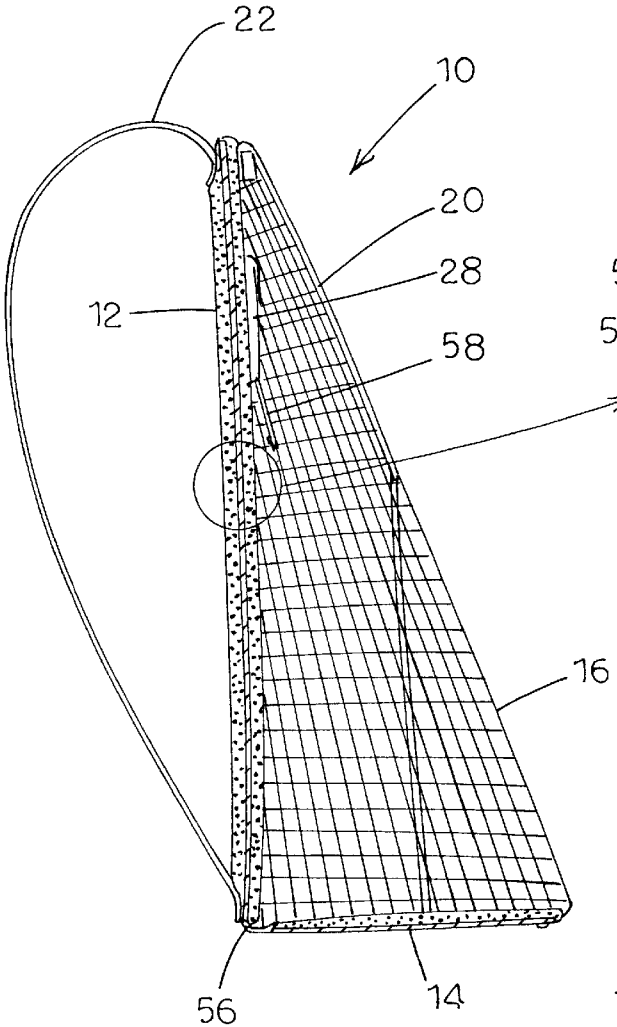
FIG. 2 is a section view of the sports equipment bag of the present invention, depicting the construction of the back and bottom members.

The construction of the back 12 and bottom 14 are discussed with reference to FIG. 2, depicting a section view of the sports equipment bag 10. Both the back 12 and bottom 14 are formed of a semi-rigid construction. That is, they are sufficiently rigid to stand alone upright, yet they are sufficiently pliable to enable them to be bent, folded, or rolled, such as for storage. The members 12, 14 are formed in a layered construction, with a core 50 covered on at least one side with a padding 52 and on both sides by fabric 54. The core 50 is of a generally flat shape and is formed from a pliant material such as cardboard, plastic, or sheet metal. The padding 52 may comprise a thin sheet of foam or any other type of rubber or foam material. In the embodiment depicted in FIG. 2, the bottom member 14 includes padding 52 only on the upper side of the core 50, and the back member 12 includes padding 52 on both sides of the core 50. In other embodiments of the present invention, one, both, or neither of the back 12 and bottom 14 may include a single layer of padding 52, or may be formed such that the core 50 is sandwiched between two layers of padding 52. The fabric 54 fully covers the back 12 and bottom 14. The fabric 54 may comprise nylon, leather, plastic, cloth, or similar suitable material, as is well known in the art.

The back 12 and bottom 14 may be connected by a seam 56, as depicted in FIG. 2. Seam 56 may stitch together the back 12 and bottom 14 formed separately, or alternatively, seam 56 may be stitched into a large extent of fabric 54 that covers both back 12 and bottom 14 in one integral construction. In another embodiment, the back 12 and bottom 14 may be formed integrally as a single panel, i.e., sharing a continuous core 50, with the seam 56 comprising a crease or fold in the core 50.

Figure 3:
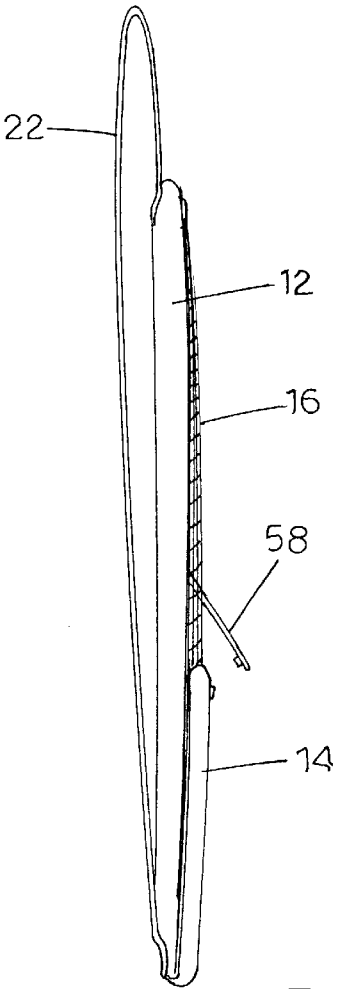
FIG. 3 is a side view of the sports equipment bag of the present invention folded into a stowed position.

The seam 56 is relatively straight, enabling it to act as a hinge. That is, when the sports equipment bag 10 is empty, the bottom 14 may be folded up adjacent the back 12, forming a stowed position. This reduces the entire sports equipment bag 10 to a compact, flat arrangement that facilitates shipping and storage thereof. FIG. 3 depicts the sports equipment bag of the present invention in such a stowed position. In the embodiment depicted in FIG. 3, storage retention strap 58 is affixed to the back 12, proximate the stowed position of the bottom 14. The retention strap 58 contains a releasable securing mechanism, with a corresponding element on the under surface of the bottom 14, to secure bottom 12 to the back 12. This securing mechanism may be any releasable securing mechanism known in the art, such as those described above with respect to the clasp 21.

To improve the efficiency and convenience of storage of various anticipated equipment items, the sports equipment bag 10 may include a variety of additional features, as depicted in FIG. 1. Retention straps 24, which maybe formed of an elastic material, are sized and positioned so as to provide convenient retention of shoes, cleats, or the like. A personal drink holder or container 26 is affixed to the back surface 12, to retain a drinking cup or bottle. A pocket 28 is provided on the back surface 12 for the retention and convenient extraction of small items, such as coins, keys, and the like. A retention flap 30 covers the top of the pocket 28, and is secured thereto by a buckle, snap, hook and loop fastener, or other conventional releasable securing means known in the art. The pocket 28 not only provides a convenient location for the storage of small items, but it prevents such items from being lost by passing through the openings in the mesh panels 16.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the spirit and scope of the invention. The present embodiments are therefore to be construed in all aspects as illustrative and not restrictive and all changes coming within the meaning and equivalency range of the appended claims are intended to be embraced therein.

What is claimed is:

1. A sports equipment bag, comprising:

semi-rigid back and bottom members;

side panels of a mesh construction affixed to said back and bottom members and at least partially overlapping to form a front surface, whereby said back and bottom members and said side panels form a storage container with a generally open top; and carrying straps affixed to said back member opposite said storage container.

2. The bag of claim 1, wherein said side panels:

are generally triangular in shape, defining three edges;

are affixed along two of said edges to the outer extent of said back and bottom members; and include an elastic edging on the third said edge.

3. The bag of claim 1, wherein said back and bottom members are sufficiently rigid such that said bag can stand alone upright.

4. The bag of claim 3, wherein said back and bottom members are formed of a layered construction comprising a core formed from a pliant material, said core covered on at least one side with a padding, and said padding covered by a fabric.

5. The bag of claim 4, wherein said pliant material is selected from the group including plastic, cardboard and sheet metal.

6. The bag of claim 4, wherein said fabric is selected from the group including nylon, leather, plastic, vinyl and cloth.

7. The bag of claim 1, wherein said carrying straps comprise two generally vertical straps, each strap affixed to said back member proximate the upper and lower extent thereof, said straps spaced apart in a horizontal direction so as to facilitate carrying said bag on a user's back, with said straps supported by the user's shoulders.

8. The bag of claim 7, wherein said straps are adjustable in length.

9. The bag of claim 7, wherein said straps are padded on at least the upper extent thereof.

10. The bag of claim 7, wherein said straps taper in width from a first width at the upper extent thereof to a second width at the lower extent thereof, said first width greater than said second width.

11. The bag of claim 7, wherein at least one said strap includes a container affixed to the outer surface thereof.

12. The bag of claim 1, wherein said back member and said bottom member are connected by a seam.

13. The bag of claim 1, wherein said back member and said bottom member are integrally formed from a single element.

14. The bag of claim 1, wherein said bottom member is foldable against said back member forming a stowed position.

15. The bag of claim 14, wherein said bottom member is releasably secured to said back member in said stowed position.

16. The bag of claim 1, further comprising a plurality of elastic straps affixed to said back member, each said elastic strap arranged and configured to retain a shoe.

17. The bag of claim 1, further comprising a drink holder affixed thereto and operative to hold a drinking container.

18. The bag of claim 1, further comprising a pocket affixed thereto.

19. The bag of claim 18 wherein said pocket includes a flap operative to secure items contained therein, said flap releasably securable to said pocket.

20. A soccer equipment bag for carrying soccer equipment, comprising:

a back and bottom formed from sufficiently rigid material so as to stand alone upright;

two sides formed from a mesh material and having surrounding edges, said edges affixed to said back and bottom, and having elastic edging on an unattached edge thereof, said sides partially overlapping opposite said back to form a front, whereby said back, bottom, and sides form a soccer equipment storage chamber with an upper opening, the size of said opening variable by stretching said elastic edging; and at least one carrying strap affixed to said back opposite said storage chamber.

21. The bag of claim 20 including two carrying straps affixed to the back opposite the storage chamber and wherein each carrying strap is affixed to the back proximate the upper and lower extent thereof and wherein the straps are laterally spaced apart.

22. The bag of claim 21, wherein said carrying straps are adjustable in length.

23. The bag of claim 22, wherein said sides are releasably secured to each other.

24. The bag of claim 23 wherein said sides are releasably secured by a mechanism selected from the group including a snap, a button and corresponding buttonhole, a hook and corresponding eyelet, tie strings, a strap with a buckle, and hook and loop fastener.

25. The bag of claim 20, further comprising a plurality of elastic straps affixed to said back surface, each said elastic strap arranged and configured to retain a shoe.

26. The bag of claim 20, further comprising a container affixed thereto operative to hold a drinking container.

27. The bag of claim 20, further comprising a pocket affixed thereto.

28. The bag of claim 27 wherein said pocket includes a flap operative to secure items contained therein, said flap releasably securable to said pocket.

29. A sports equipment bag, comprising:

a bottom;

a back;

a mesh construction secured to said bottom and back and extending therefrom so as to form a holding area that is defined by the bottom, bag and mesh construction.

30. The bag of claim 29, wherein the mesh construction includes at least two panels that are connected to the top and bottom of the bag and which extend around to form the sides in front of the bag; and wherein each mesh panel includes a diagonal disposed edge that extends from one side of a top portion of the bag to an opposite side of the bottom such that the two diagonal edges of the two mesh panels across such that a portion of the mesh panels overlap.

31. The bag of claim 29, wherein the mesh construction extends from the bag so as to form an open top that is formed by the bag and the mesh construction.

32. The bag of claim 31, including at least one strap secured to the bag for permitting an object such as a shoe to be held within the strap.

33. The bag of claim 29, wherein the mesh construction includes two mesh panels, each mesh panel secured to said bottom and back and extending therefrom to where the two mesh panels partial overlap about a front portion of said holding area.

34. The bag of claim 33, wherein said mesh panels are releasably secured to each other at said partial overlap to retain equipment deposited in said holding area.

35. The bag of claim 33, wherein said mesh panels are disposed with respect to said back so as to form an open top construction to permit equipment to be deposited in said top.

36. The bag of claim 35, wherein said mesh panels have an unattached edge that includes an elastic segment that permits said mesh panels to be stretched open.

* * * * *